United States Patent [19]

Sohlberg et al.

[11] Patent Number: 4,633,650

[45] Date of Patent: Jan. 6, 1987

[54] METHOD AND A DEVICE FOR CUTTING END DISKS FOR THE PACKING OF PAPER ROLLS

[75] Inventors: Jan-Henrik Sohlberg; Seth I. S. Olsson, both of Forshaga, Sweden

[73] Assignee: Broderna Solbergs Forsaljnings Aktiebolag, Forshaga, Sweden

[21] Appl. No.: 785,528

[22] Filed: Oct. 8, 1985

[30] Foreign Application Priority Data

Oct. 12, 1984 [SE] Sweden ..... 8405106

[51] Int. Cl.[4] ..... B65B 59/00; B65B 61/06

[52] U.S. Cl. ..... 53/415; 53/66; 53/137; 53/140; 53/168; 53/296; 53/371

[58] Field of Search ..... 53/137, 504, 415, 66, 53/419, 476, 478, 168, 129, 140, 296, 139.3; 83/358, 363, 367, 371

[56] References Cited

U.S. PATENT DOCUMENTS

| | | | |
|---|---|---|---|
| 2,831,304 | 4/1958 | Michaud | 53/137 X |
| 2,912,809 | 11/1959 | Bowman | 53/137 |
| 3,182,539 | 5/1965 | Williams, Jr. | 53/66 X |
| 3,196,591 | 7/1965 | Guido et al. | 53/66 X |
| 3,540,187 | 11/1970 | Monaghan | 53/66 X |
| 3,776,081 | 12/1973 | Becker | 53/168 UX |
| 3,841,054 | 10/1974 | Thompson et al. | 53/168 X |
| 4,383,537 | 5/1983 | Van der Haar et al. | 83/371 X |
| 4,534,151 | 8/1985 | Schneck et al. | 53/139.3 X |

FOREIGN PATENT DOCUMENTS

| | | | |
|---|---|---|---|
| 2838862 | 9/1977 | Fed. Rep. of Germany | 53/137 |

*Primary Examiner*—Horace M. Culver

*Attorney, Agent, or Firm*—Murray and Whisenhunt

[57] ABSTRACT

The invention relates to a method and a device for the cutting of end disks for the packing of paper rolls. The invention is characterized in that the diameter of each roll is measured in a measuring unit (1) in a production line, that the number of disk blanks (21, 242) needed for the packing of one paper roll are fed from one or several disk blank magazines (20, 200–203) and placed on and fixed against a cutting table (13, 221), rotatable about a center axis, said table being a part of a cutting unit (10, 205), that a knife (128) of a knife unit (9, 223) in said cutting unit is set at a radial distance from the turning center of the cutting table which corresponds very closely to half of said measured diameter, by translational means (8) for this purpose and on the basis of the values measured by the measuring unit, that disks **(21*b*, 245)** are cut from the blanks by rotating the cutting table in relation to the stationary knife, and that the cut disks and the annular excess material are removed from the cutting table separately.

12 Claims, 13 Drawing Figures

METHOD AND A DEVICE FOR CUTTING END DISKS FOR THE PACKING OF PAPER ROLLS

TECHNICAL FIELD

The invention relates to a method and a device for cutting end disks for the packing of large paper rolls.

BACKGROUND ART

The use of end disks made of corrugated fibreboard or paperboard for the packing of large paper rolls is very widespread. To ensure good packing, the end disks should cover the two ends of the paper roll entirely, before being fixed by the folding down of the wrapping paper on the outside of the roll. On the other hand, however, the end disks must not be too large, since they may then easily cut through and damage the wrapping material. It would be desirable to have access at all times to end disks the diameter of which is very nearly the same as that of the paper rolls. Prior art does not provide this possibility. Compromises have thus been necessary. A supply of disks of different diameters has been prepared in advance. In order to keep the number of sizes down a dimension interval of 5 cm has usually been applied and the drawbacks of this system, such as cumbersome handling, transport damage etc, have been accepted.

DISCLOSURE OF THE INVENTION

The object of the invention is to provide a method and a device for individual tailoring of end disks, so that their diameter with a high degree of accuracy corresponds to the diameter of the paper rolls to be packed at any time. Specifically, the invention aims at the production of two end disks—or as many disks as are needed for the packing of one specific paper roll—in the packing line at a speed which means that the cutting of the disks does not lower the speed of the production line. This requires that the cutting of the disks for each paper roll must not take more than appr. ½ min. exclusive of manual handling. The precision with respect to the diameter is set at ±1 mm.

These and other objects may be realized by a method and a device with the characteristics defined in the patent claims.

Further objects and characteristics of the invention will become apparent from the following description.

BRIEF DESCRIPTION OF DRAWINGS

In the following description of a preferred embodiment, reference will be made to the appended drawings, wherein.

DESCRIPTION OF PREFERRED EMBODIMENTS

Figure 1:
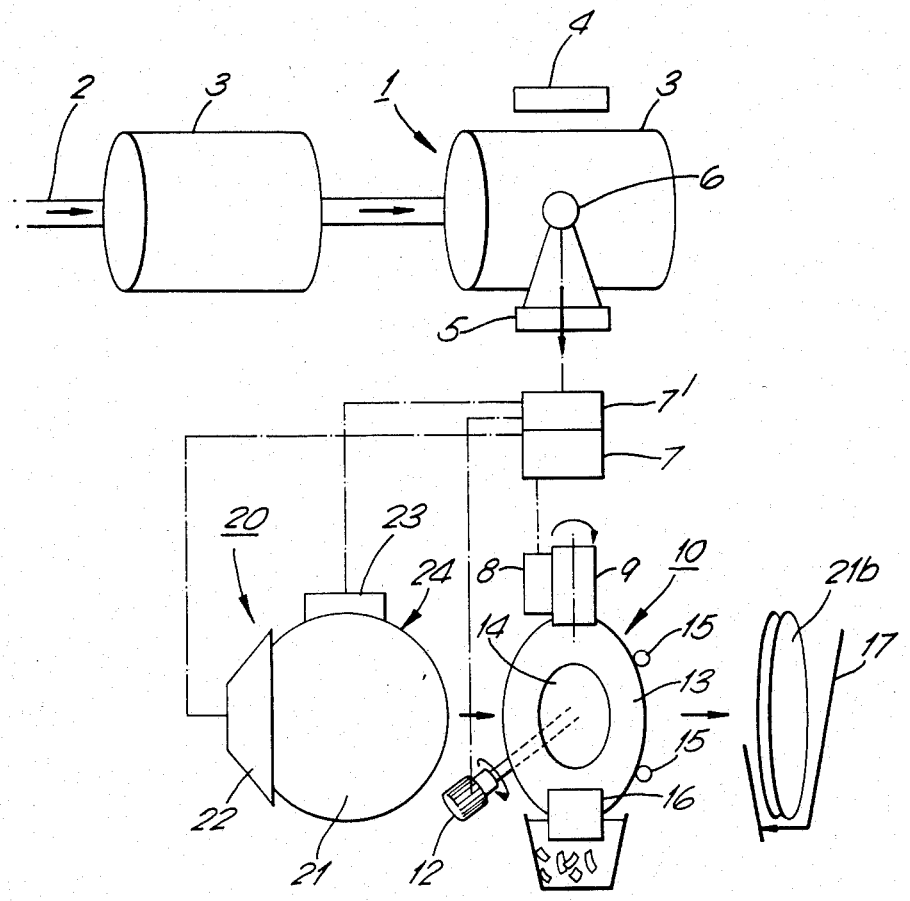
FIG. 1 is a schematic view of the main features of the invention, according to a first preferred embodiment.
Figure 2:
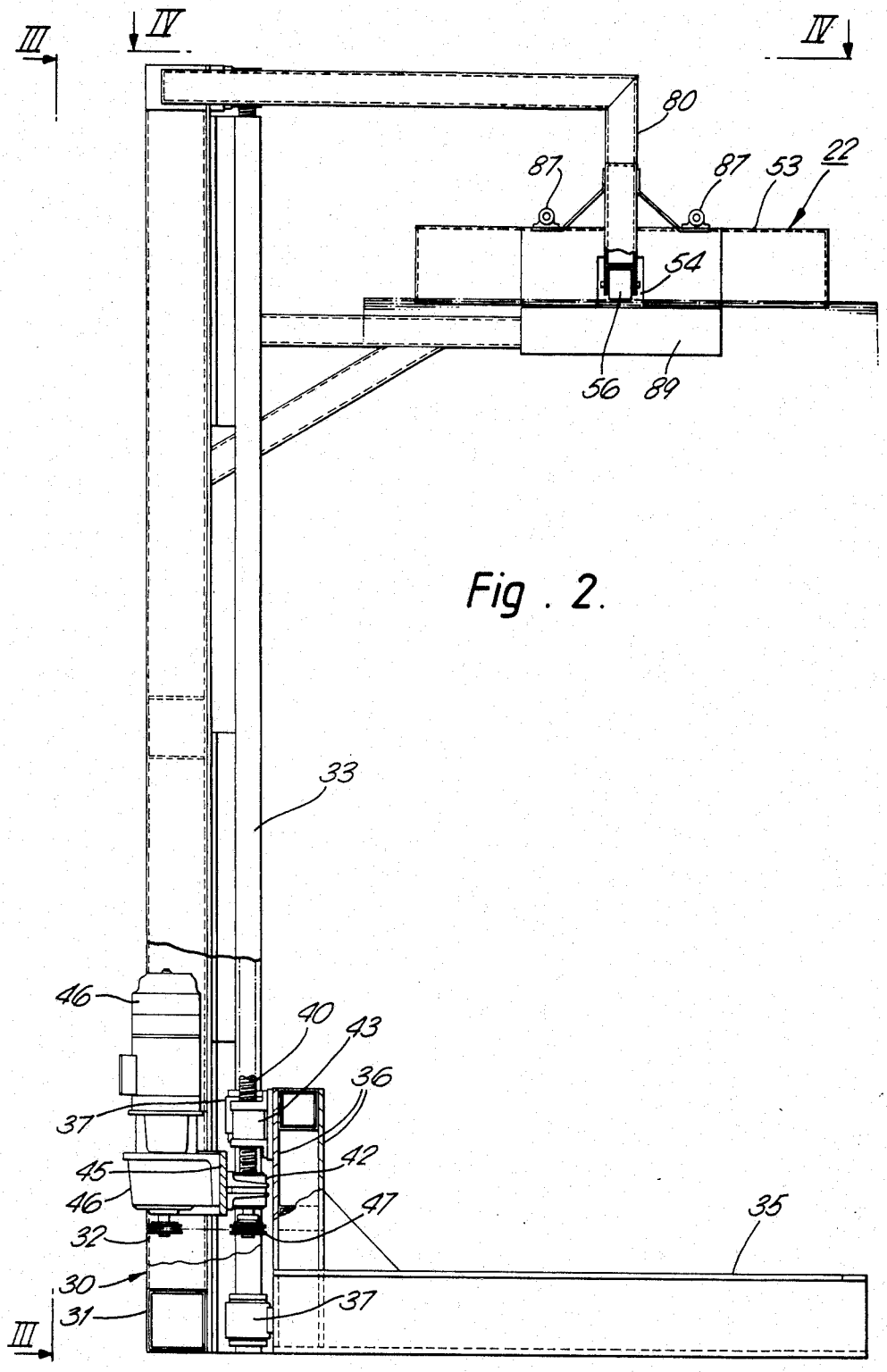
FIG. 2 is a rear view of a magazine for disk blanks and a feeding device for the feeding of two blanks at a time.
Figure 3:
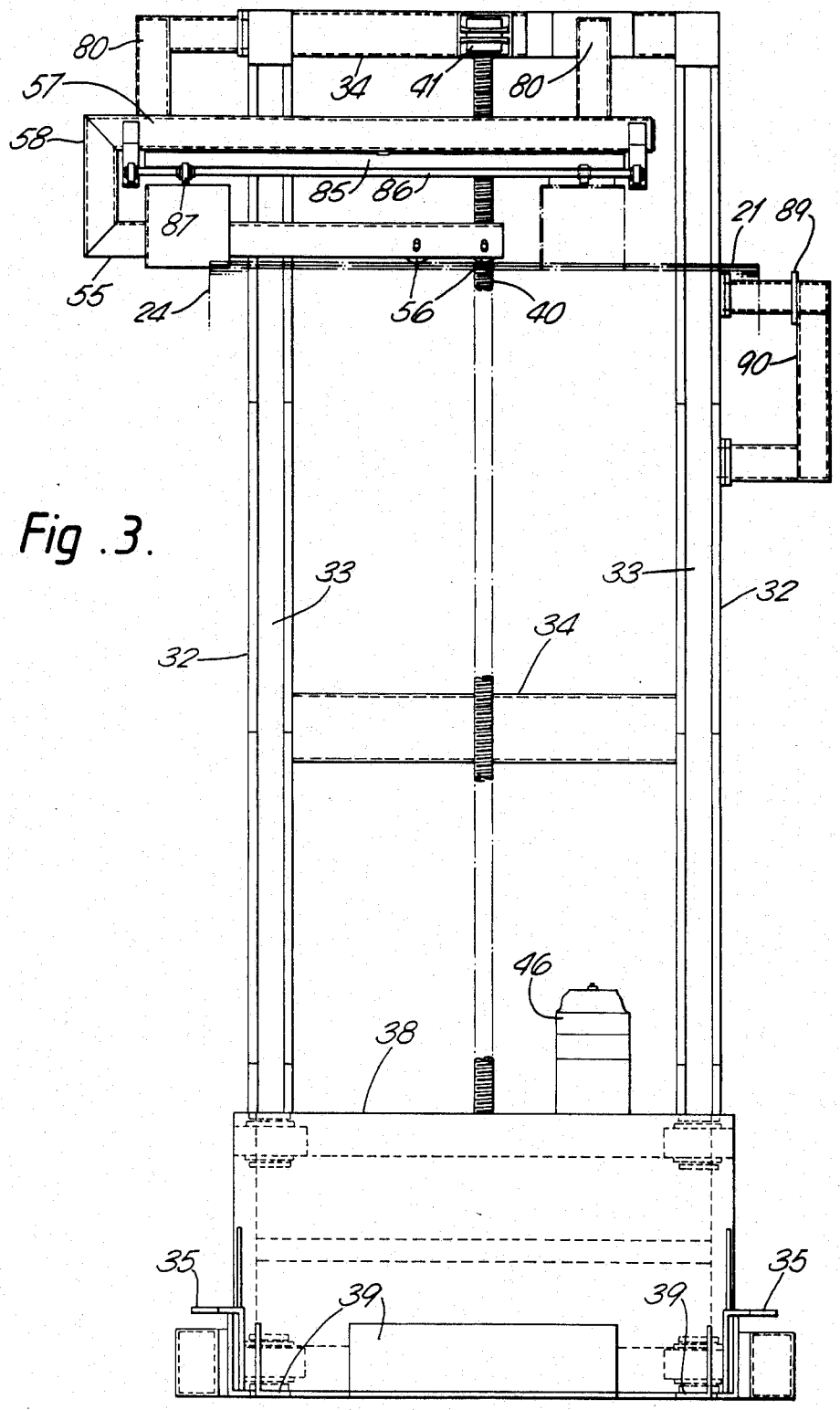
FIG. 3 is an elevation corresponding to III—III of FIG. 2.
Figure 4:
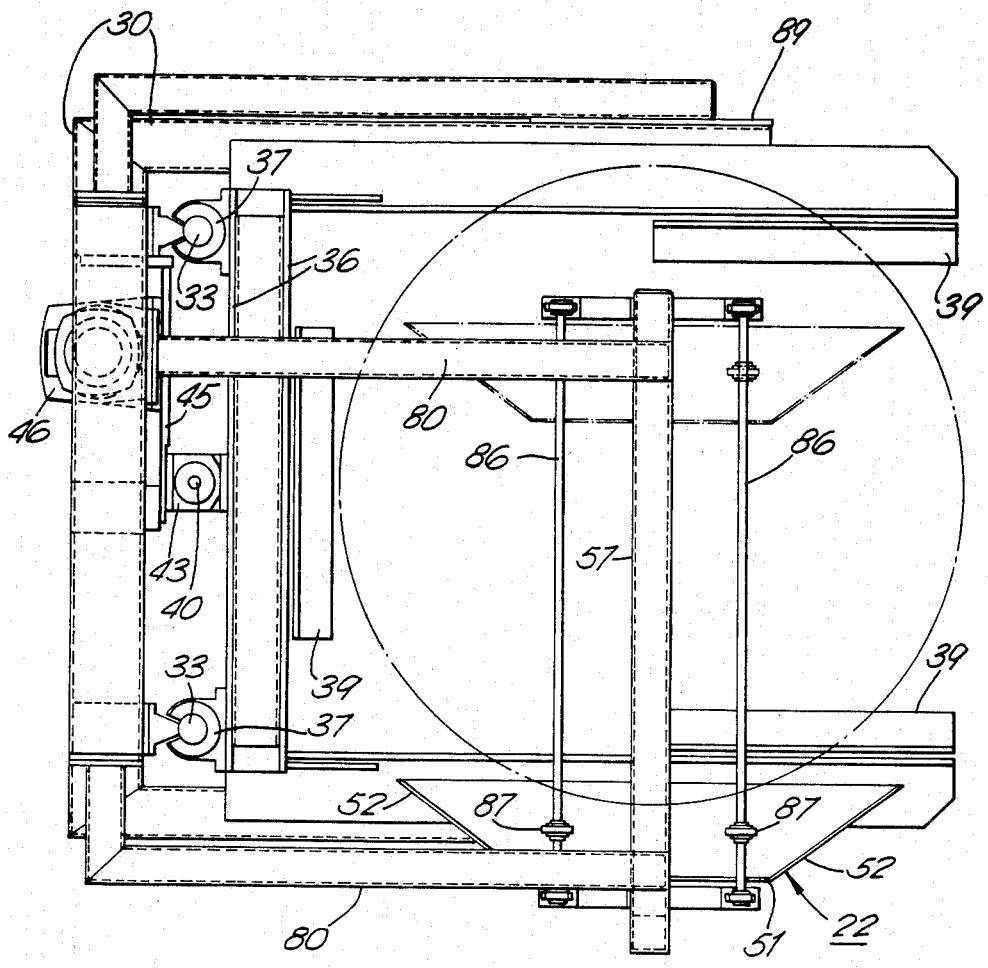
FIG. 4 is a plan view corresponding to IV—IV of FIG. 2.

The major parts of the device according to the first embodiment and the principles according to which it functions will first be described with reference to FIG. 1, and then the particulars of the equipment and its function according to this first embodiment will be described with reference to FIGS. 2–10.

A measuring station 1 is located near a transverse conveyor 2 for paper rolls 3, which are being fed one at a time from a couple of paper roll machines, not shown. The measuring station 1 more specifically is located near the expeller 4 of the conveyor 2, and comprises a frame 5 and an ultrasonic measuring unit 6. The measuring station 1 measures each roll 3 up to five times. Any extreme measurements are disregarded and a mean value of the remaining measurements is used as a measurement value in the system.

The measured value is fed in the form of a current level to a process-computer 7' and from there to a servo amplifier 7, the output of which controls a servo adjuster 8 with a built-in servo potentiometer. The adjuster 8 is coupled to a knife unit 9 which is part of a cutting unit 10 for cutting end disks **21*b*, the diameter of which very closely matches that of the paper roll at hand. The servo amplifier 7** is also designed to deliver a signal to acknowledge the match between the position of the knife and the registered measurement, in other words the match between set value and actual value.

Further, the cutting unit 10 comprises a drive unit 12 with a base plate or cutting table 13, an upper press plate 14, a catch unit 15 to ensure that the disk blanks are centered on the cutting table 13, a feeding and shredding unit 16 for the excess material, and a floor stand, not shown in FIG. 1, with a pivoting frame for the cutting table 13, the knife unit 9 with the adjuster 8, and the feeding and shredding unit 16, and in addition, a box 17 for finished disks **21*b***.

Finally, the basic unit also includes a magazine 20 for blanks. According to one embodiment, the blanks 21 are made of corrugated fibreboard, 7 mm thick. At the top of the blank magazine 20 there is a feeder 22 for the feeding of (in the case at hand) two disk blanks at a time, which are expelled straight out so that they slide onto the lower plate 13 (the cutting table) of the cutting unit 10. The blank magazine also comprises means for lifting, generally designated 23, arranged to lift the staple 24 consisting of disk blanks during each working cycle a distance upwards which corresponds to the total thickness of the number of disk blanks 21, preferably two, to be used for covering the two ends of each paper roll. In case two disks of 7 mm corrugated fibreboard are to be used, the staple 24 is consequently lifted 14 mm by the lifting means 23 during each working cycle. This movement, plus the movement of the feeder 22, and the functions of the cutting unit 10 are controlled by the process computer 7' via the servo amplifier 7. If the thickness of the disk blanks 21 differs from 7 mm, the program of the process computer is changed accordingly, so that the staple 24 is lifted each time a distance corresponding to twice the thickness of the disks, or a distance which corresponds to the total thickness of the disks which are to be used for the packing of one paper roll.

Below, the cutter unit 10 and the disk blank magazine 20 will be described in greater detail. First, the disk blank magazine will be described with reference to FIGS. 2–4. A frame for the disk blank magazine has been designated 30. This frame consists of a stand 31 with a pair of vertical columns 32. On each of the columns 32 is mounted a guide member 33. The guide members 33 are connected by a number of transverse beams 34. Two supporting arms for the staple 24 consisting of circular disk blanks 21 have been designated 35. The arms 35 are attached to the guide members all the way down to floor level. Behind the box formed by the plates 36 and the intermediate beams there are a pair of ball bushings 37 mounted on the respective guide member 33. To align the staple 24, so that it is placed correctly on the arms 35, three guiding arms 39 have been bolted to the floor. These arms are used to center a pallet, which initially carries the staple 24, as the disk blank magazine 20 is "loaded". As soon as the magazine 20 has been loaded in this way, the arms 35 are raised on the outside of the pallet and lift the staple 24 itself. Hence, the staple 24 only rests on the arms 35 along a pair of opposite segments.

Intermediate the guide members 33 there is a vertical ball bearing screw to with upper and lower bearings 41 and 42, respectively. On the back side of the plate box 36 there is a ball bearing screw nut 43. A gear motor 46 is mounted on a bracket 45 on the frame 30, and is arranged to be able to turn the ball bearing screw 40 via a belt transmission 47. The turning of the gear motor 46 is controlled by the process computer 7' of FIG. 1. The lifting means 23 indicated in FIG. 1 thus comprise the gear motor 46, the transmission 47, the ball bearing screw nut 43, and the ball bearing screw 40. Together, these components lift the plate box 36, the arms 35, and consequently the staple 24.

The feeder 22 expels the disk blanks from the magazine 20. It consists of a rear vertical plate 51 and two side plates 52, tapering towards the rear plate 51. The vertical plates 51, 52 are also interconnected by a cover plate 53. In the rear plate 51 there is an opening 54 through which extends a horizontal beam 55. This beam is provided with a pair of rollers 56, which constitute upper stops for the staple 24. The beam 55 is carried by a beam 57 above it via a vertical interconnecting piece 58. The beam 57 in turn is supported by a pair of arms 80, attached to the frame 30. On the beam 57 a so called Origa® cylinder 85 is mounted, i.e. a cylinder without a piston rod but provided with a radially extending dog. This dog is attached to the feeder 22. The beam 57 also supports a pair of guides 86, which correspond to a pair of bushings 87 on the upper plate 53 and on the feeder 22. By means of the Origa® cylinder 85, the feeder may thus be moved back and forth along the guides 86, expelling two disk blanks 21 from the staple 24, using its vertical plates 51, 52.

To ensure that neither more nor less than two disk blanks 21 are expelled for each working stroke of the Origa® cylinder 85, the assembly includes the following functions and devices: Firstly, the staple 24 is lifted during each working cycle a distance equal to the thickness of, in the case at hand, two disk blanks 21. The thickness may vary a little, however, depending on the humidity, and the form may also change slightly. To provide a constant upper level from which to start, the beam 55 with the rollers 56 is provided.

These rollers are also provided with electric switches, which in case of emergency are able to stop the upward action of the gear motor 46, or can order the gear motor 46 to continue its upward action, via the process computer 7'. The vertical plates 51, 52 of the feeder 22 extend with their lower edge to a level which corresponds approximately to the second disk blank of the staple 24 or at least to a level below the upper and above the lower surface of said second disk blank. If, in spite of this, more than two blanks 21 were to be expelled as the Origa® cylinder 85 makes its feeding stroke, there is a dolly 89 on the feeding side of the staple 24. This dolly is approximately level with the third blank of the staple. Should three blanks start to be expelled from the staple, the lower of these would thus be stopped by the dolly 89, which is mounted to a beam structure 90 in the frame 30.

Figure 5:
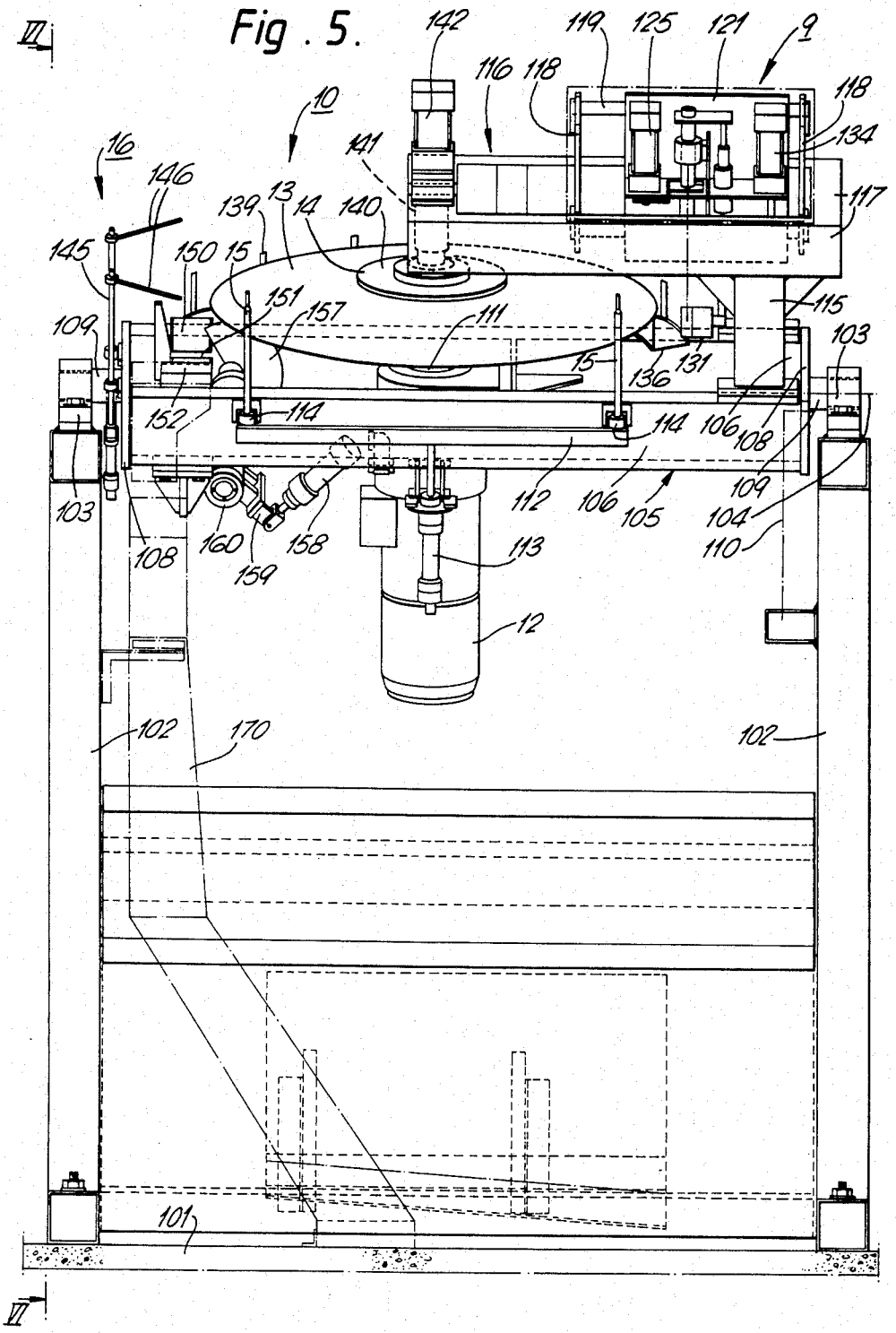
FIG. 5 is a front view of a first preferred embodiment of a cutting device.
Figure 6:
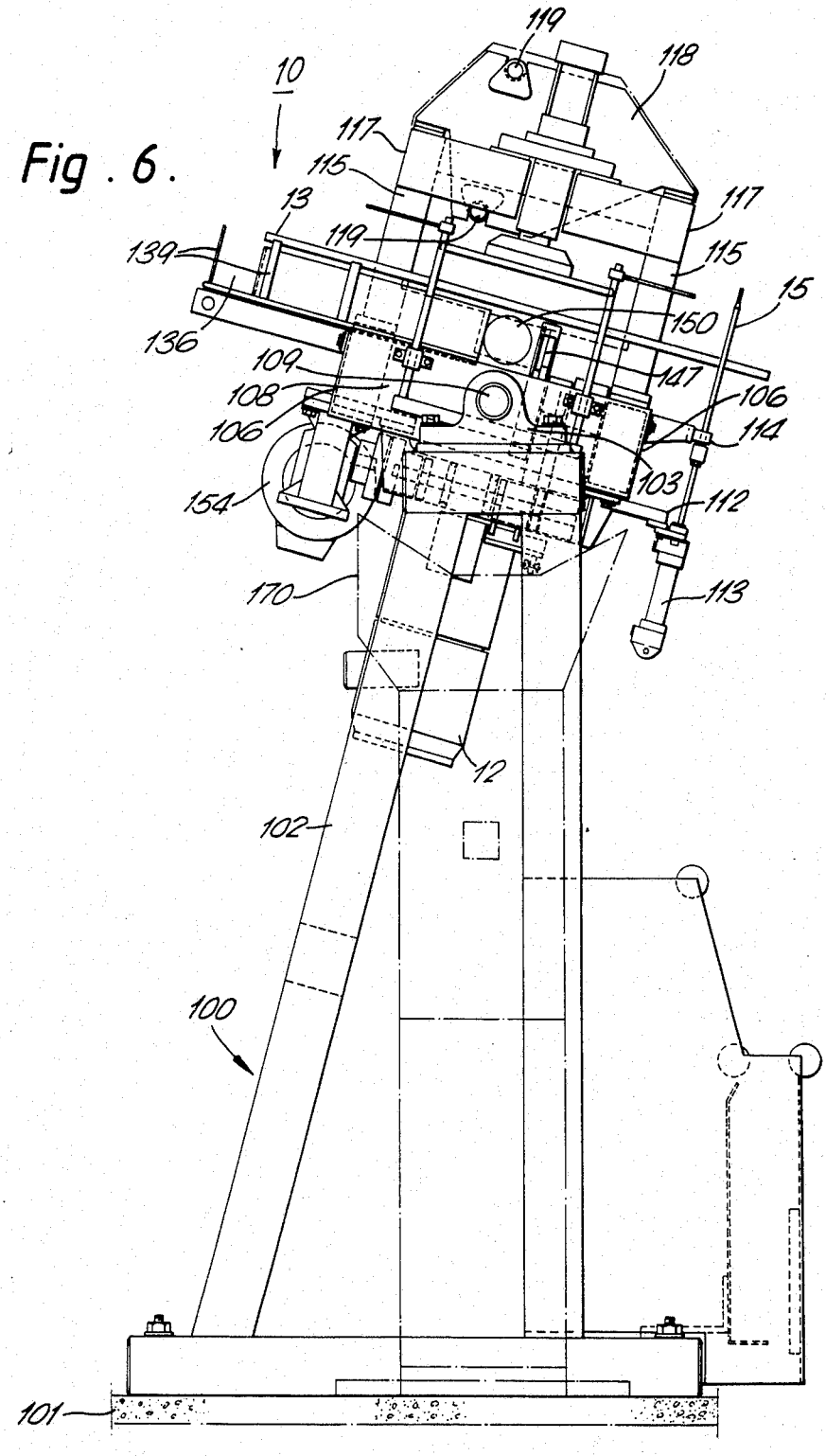
FIG. 6 is a view corresponding to VI—VI of FIG. 5.

Referring now to FIGS. 5 and 6, the cutting unit 10 will be explained in greater detail. A base frame has been generally designated 100, and is bolted to the floor 101. The frame 100 consists of two parallel and vertical bearing supports 102, each supporting a bearing housing 103 for bearings with a common horizontal turning axis 104. The cutting unit 10 pivots in the bearings of the bearing housing 103. More specifically, the cutting unit 10 is mounted on a lower framework 105 consisting of a pair of parallel, longitudinal beams 106 and a pair of end plates 108 with pivot pins 109, journalled in the bearing housings 103. The turning of the framework 105 and consequently of the cutter 10 about the axis 104 is accomplished by means of a pneumatic cylinder 110 (indicated by dotted lines only) supported by the frame 100. In this manner, the framework 105 may be inclined between 15° and 75° in relation to the horizontal plane, in other words turn 60° in all about its turning axis 104.

The drive unit for the cutting table 13 is a gear motor 12, mounted on the framework 105. The drive shaft 111 of the motor 12 is attached to the bottom side of the cutting table 13.

The catch intended to ensure that the disk blanks are centered on the cutting table 13 consists of two pins 15, which catch the circular blanks at their perifery, as they slide down the cutting table 13, which in this phase is inclined at 15° to the horizontal. The pins 15 are located in such a way that an angle of 45° is formed in the horizontal plane between the pins and the disk center. The pins 15 are mounted to a common rod 112, which may be pulled down or lifted by means of a pneumatic cylinder 113 on the framework 105. A pair of box guides 114 guide the pins 15.

There are a pair of legs 115, mounted to the longsides 106 of the framework 105, on the right side thereof as viewed according to FIG. 5. These legs 115 support a top framework 116, comprising two horizontal longitudinal beams 117, extending towards the center of the cutting unit 10. On the beams 117 rest a pair of end plates 118, forming the ends of the knife unit 9. In the end plates 118 there are mounted two horizontal guide rods 119, one on top of the other, see also FIGS. 7 and 8. On the guide rods 119 are mounted ball bushings 120 which support a slidable mounting plate or car 121. Behind the mounting plate 121 on the upper framework 116 is mounted the servo adjuster 8 with its built-in servo potentiometer. The adjuster 8 is arranged to displace the knife unit 109 on the order of the process computer 7' transmitted by the servo amplifier 7, by moving the mounting plate 121 to different positions between the end plates 118.

Figure 7:
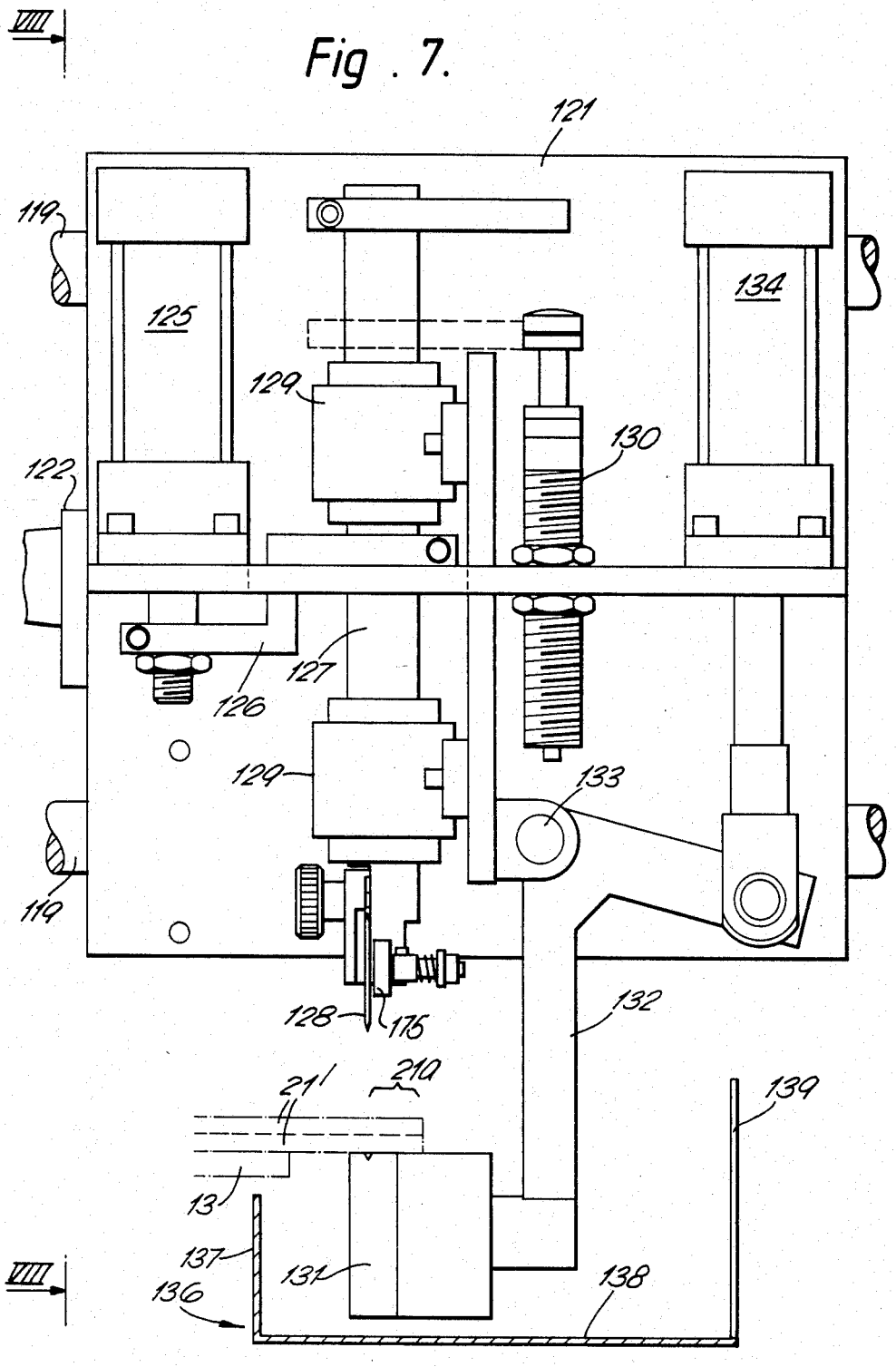
FIG. 7 is a view in greater detail of a cutting device of FIG. 5.
Figure 8:
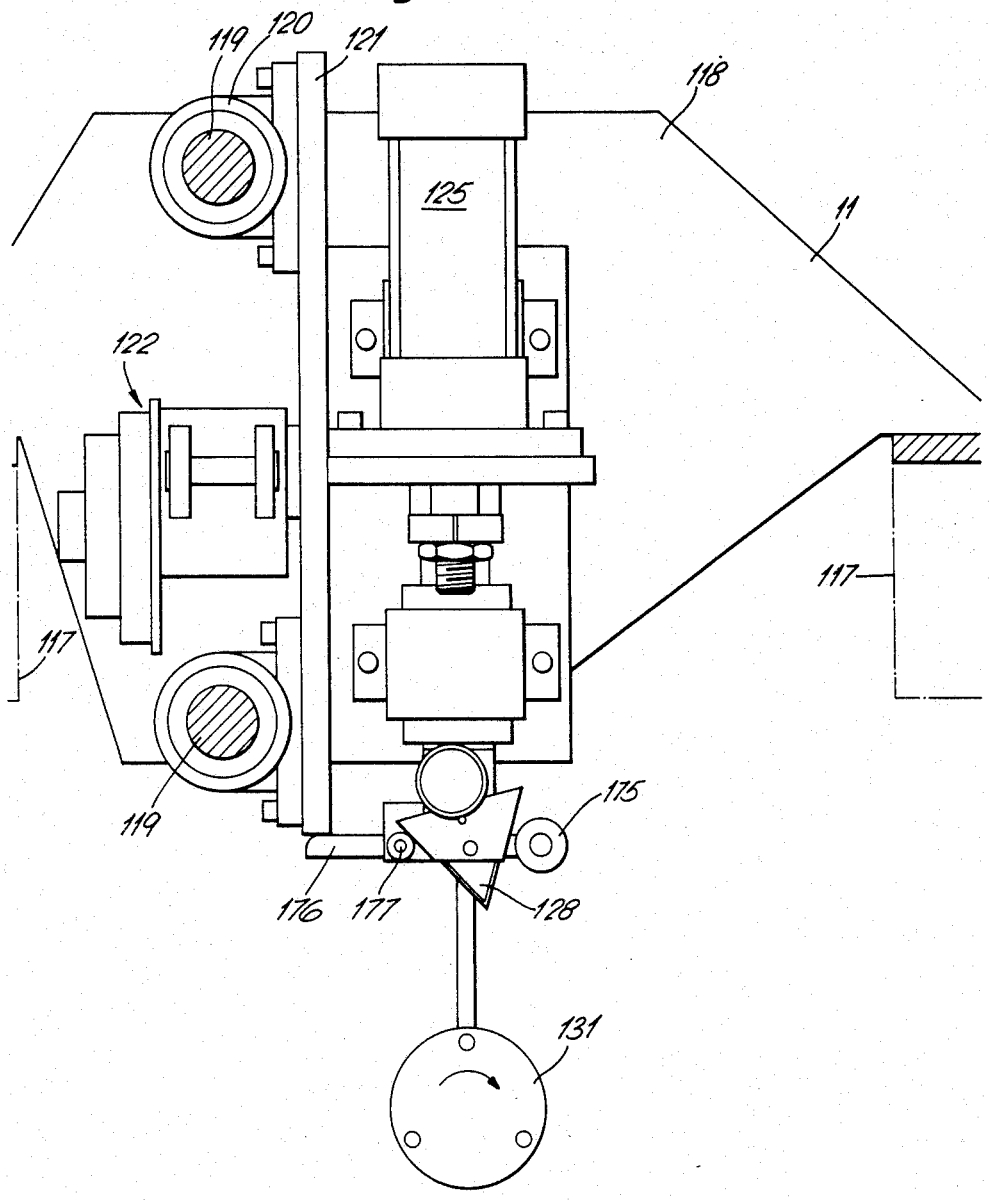
FIG. 8 is a view of the same cutting device plus a positioning device, corresponding to VIII—VIII of FIG. 7.

FIG. 7 best illustrates how the different components are arranged on the car—sliding plate—121, sliding on the guide rods 119. At the far left of the car 121 there is a pneumatic cylinder 125, the piston rod of which is connected rigidly at 126 to a shaft 127, the lower end of which carries a knife 128. The shaft 127 is slidable in ball bushings 129. To the right of the shaft 127 and the bushings 129 there is a shock absorber 130, adjustable so as to give the knife 128 the desired speed during the last phase of its downward feeding movement. The cylinder 125 thus runs the shaft 127 with the knife 128 down toward the shock absorber 130, which slows down the motion so that the knife 128 gets the suitable speed during the last phase as it cuts through the two disk blanks 21', which lie on the cuttin table 13. Underneath the outer edge region of the blanks 21' there is a counter-roller 131 directly opposite the knife 128. The counter-roller 131 is mounted to a two-armed lever 132, which pivots about a hinge 133 under the action of a pneumatic cylinder 134 on the right-hand part of the car 121, the pneumatic cylinder thus being able to remove the counter-roller 131 and vice versa. The order to the cylinder 134 to remove the roller 131 is issued by the process computer 7' as soon as the disks have been cut completely, so as to permit the annular waste material to fall down into a waste through 136, which forms a scant half-circle along the upper half of the cutting table 13. The trough 136 simply consists of an inner wall 137 and a bottom 138 between the knife unit 109 and the shredding and feeding unit 16 on the opposite side of the cutting unit 10, so that the counter-roller 131 and parts of the unit 16 may be moved aside, as will be explained below. The outer confinement of the trough 136 is a number of vertical pins 139. According to the embodiment, the knife 128 is triangular, with exchangable cutting edges on each side.

The previously mentioned pressing plate 14 is provided to press the two disk blanks 21' against the cutting table. This pressing disk 14 is via a bearing 140 connected to a shaft 141, which may be moved in a ball bushing by means of a pneumatic cylinder 142. The pressing plate 14 may thus rotate with the cutting table 13 by turning in the bearing 140 and press the disk blanks 21' against the table 13. The pneumatic cylinder 142 and said ball bushing are attached to the beams 117.

Figure 9:
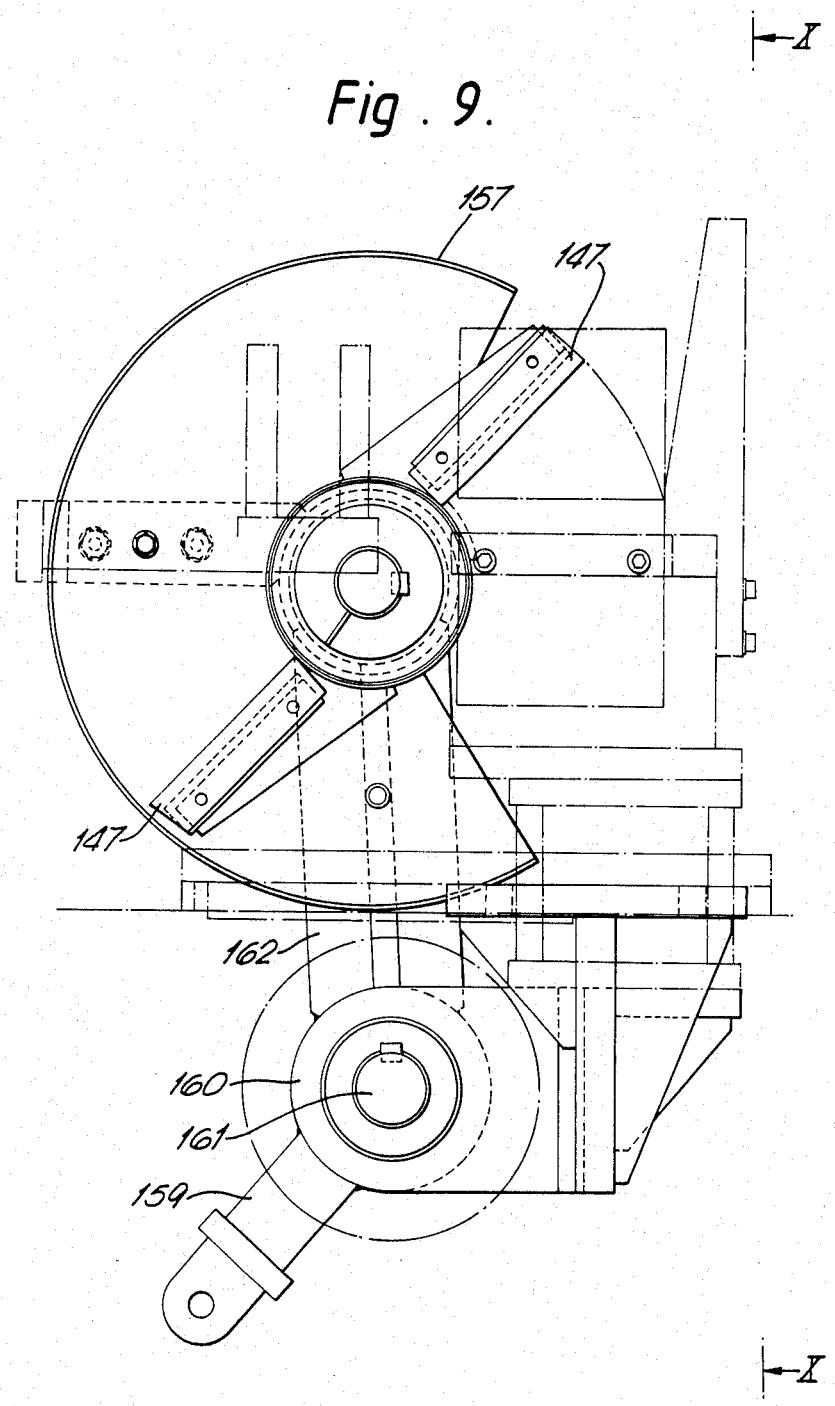
FIG. 9 is a view from the opposite side of the shredding and feeding device for the cutting of the excess annular material.
Figure 10:
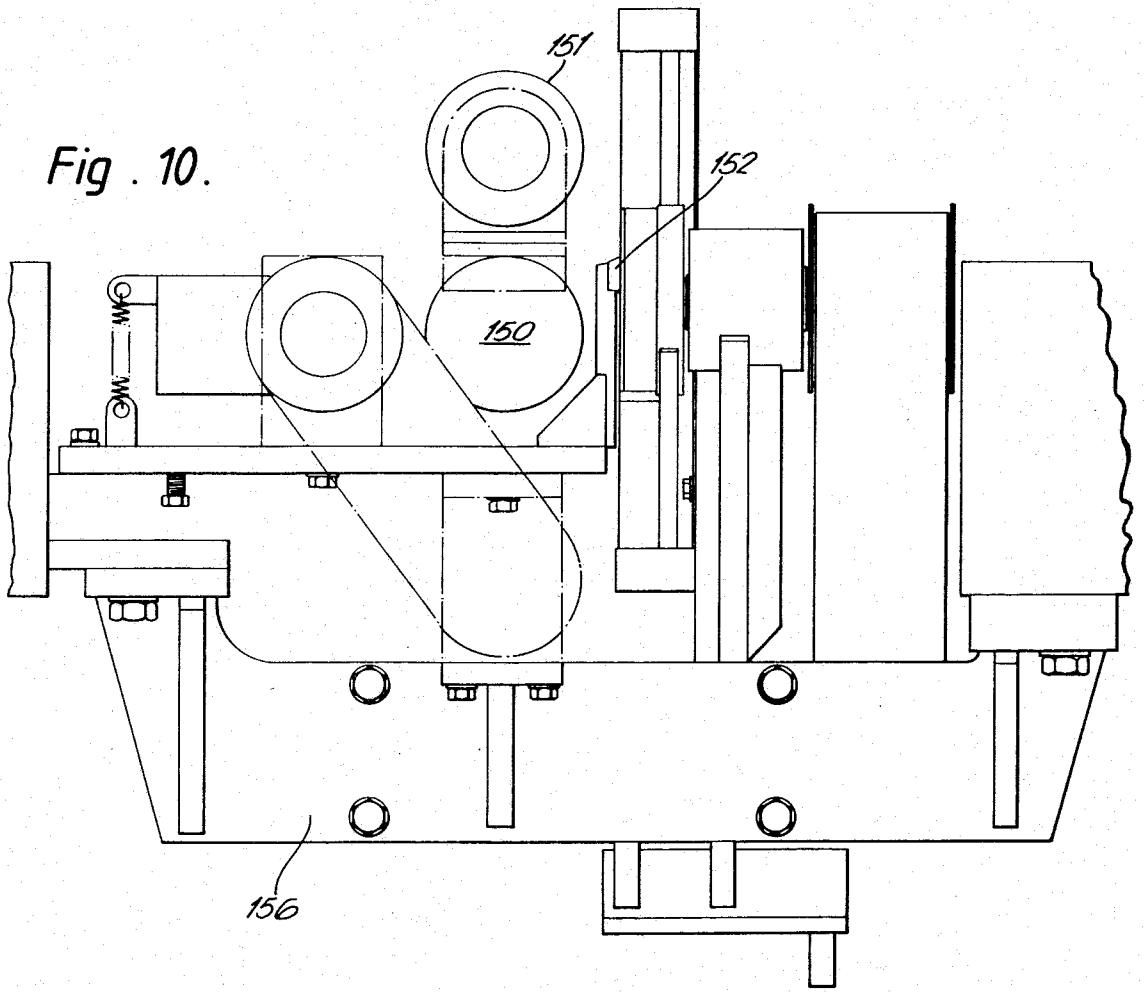
FIG. 10 is a view corresponding to X—X of FIG. 9.

Proceeding now to the description of the shredding unit 16, reference is made to FIGS. 9 and 10. The shredding unit 16 is intended to shred the annular excess material **21*a* cut off by the knife 128, see FIG. 7, and consists of a pressing unit 145, a feeding unit 146, and a rotatable knife 147. The shredding unit 16 is mounted on a beam 156, hanging from the pivoting lower framework 105**.

The pressing unit 145 consists of two air powered catch arms 148, mounted one on each side of the feeding unit 146. The catch arms 148 are intended to end up in the trough 136, so that the finished end disks **21*b* may leave the cutting table 13 unobstructed and so that the excess material may be fed to the rotating knife 147 by the feeding unit 146**.

The feeding unit 146 consists of a driven bottom roll 150 and a driven removable top roll 151. A stationary counter-knife has been designated 152. Both the rotating knives 147 and the feeding rolls 150, 151 are powered by a motor 154 via belt drives, which hardly need any further comments. A protective cover for the rotating knives 147 has been designated 157. In order that the disk blanks 21' be able to slide down onto the cutting table 13 from the disk blank magazine, the top feeding roll and the rotating knives 147 with the protective cover must be moved aside. To this end there is provided a pneumatic cylinder 158, the piston rod of which is attached to the one end of e lever 159, which turns a sleeve 160 about a turning axis 161. To the sleeve 160 is attached a second lever arm 162, to which is attached both the rotating knives 147 and the top feeding roll 151.

Included in the arrangement is also a funnel or the like 170 below the shredding unit 16 to collect shredded excess material and a box 17 for finished disks, see FIG. 6. At the bottom of the box 17 there is preferably a layer of foam rubber 127 and at the front of it a brush 173, guiding the disks **21*b*, so that they align themselves as indicated in FIG. 6**.

The described arrangement functions as follows. Initially, the upper and lower framework 105 and 116, respectively, of the cutting unit 10, and consequently the cutting table 13 as well, incline 15° to the horizontal plane. The cutting table 13 is empty. The working cycle is initiated by a paper roll 3 arriving at the measuring station 1. The cutting motor 154 starts and the feeding rolls 150 and 151 feed any remaining excess material from the preceding working cycle into the trough 136. This excess material is cut into pieces by the rotating knives 147, working below the level of the cutting table 13. At the same time as the cutting motor starts, the diameter of the roll 3 is measured by means of the ultrasonic measuring unit 6.

The measurement value is processed in the process computer 7' and transmitted in the form of a current signal to the servo amplifier 7, the output of which controls the adjuster 8 with its built-in servo potentiometer and a disk motor for the displacement of the car—the plate—121 along the guide rods 119, the knife 128 thus being positioned at a distance from the center line of the cutting unit 10 which corresponds very closely (±1 mm of the diameter) to the measured value of the diameter of the paper roll 3. The servo amplifier supplies an acknowledging signal when the knife setting coincides with the measured diameter value.

In conjunction with the above procedures, the staple 24 with disk blanks is lifted, until it strikes the rollers 56, by means of the gear motor 46 via the belt drive 32 and the ball screw 33. The two top disk blanks 21 are fed from the magazine 20 by the feeder 22. They are fed directly onto the cutting table 13, the inclination of which is still 15° to the horizontal plane, and slide down along the table until they hit the catch pins 15, which ensure that the disk blanks are centered on the cutting table 13.

When the two disk blanks 21', FIG. 7, are in place on the cutting table 13, manual acknowledgement is made that the disks are to be cut. The upper press plate 14 is then pressed down by the air cylinder 142 and press the disk blanks 21' against the cutting table 13. The catch pins 15 are lowered by the air cylinder 113. The drive unit 12 starts and turns the cutting table 13 with the two disk blanks 21' and the press plate 14 about its journal 140. The knife 128 is lowered down toward the roll 131 by the air cylinder 125, and cuts fully through the two rotating disk blanks 21'. The cutting table 13 rotates a number of turns with the knife 128 in cutting position, so that an annular excess material 21a is cut off. A castor 175 behind and outside the knife 128 is forced down by the turning of a spring loaded arm 176 about a turning axis 177, the excess material 21a which has been cut off gradually being pressed down so as to lose contact with the disks 21 which are gradually being cut out, and eventually falling down toward the trough 136.

During the cutting operation the shredding and feeding device 16 opens. More specifically, the top feeding roll 150 and the rotating knives 147 are moved aside by the air cylinder 158. As the cutting is completed, the annular excess material 21a is pressed down toward the bottom feeding roll 151 by means of the pressing unit 145. Again, the shredding and feeding unit is lowered, and the top feeding roll 150 is moved back into feeding position by the air cylinder 158. The cutting motor starts anew. The annular excess material is fed along the trough 136 between the two feeding rolls 151 and 151 and is cut into pieces by the rotating knives 147. The shredded material is funneled off through the waste funnel 170.

During the cutting operation the cutting unit 10 is turned 60° about its turning axis 140 by means of the air cylinder 110, in other words to an inclination of 75° to the horizontal plane. The upper press disk 14 is lifted to its starting position and the two finished disks 21b slide down along the cutting table which now slopes steeply, and finally fall freely into the box 17, where their fall is damped by the foam rubber 172 at the bottom of the box and by the brushes 173 at the front of it. The disks 21b are removed manually. The shredding goes on until the trough 136 is empty. The cutting unit 10 is turned 60° back to its starting position. The catch pins 15 are moved back up. The working cycle is thereby completed, and with the described embodiment the time required is 35 seconds, manual operations excluded.

Figure 11:
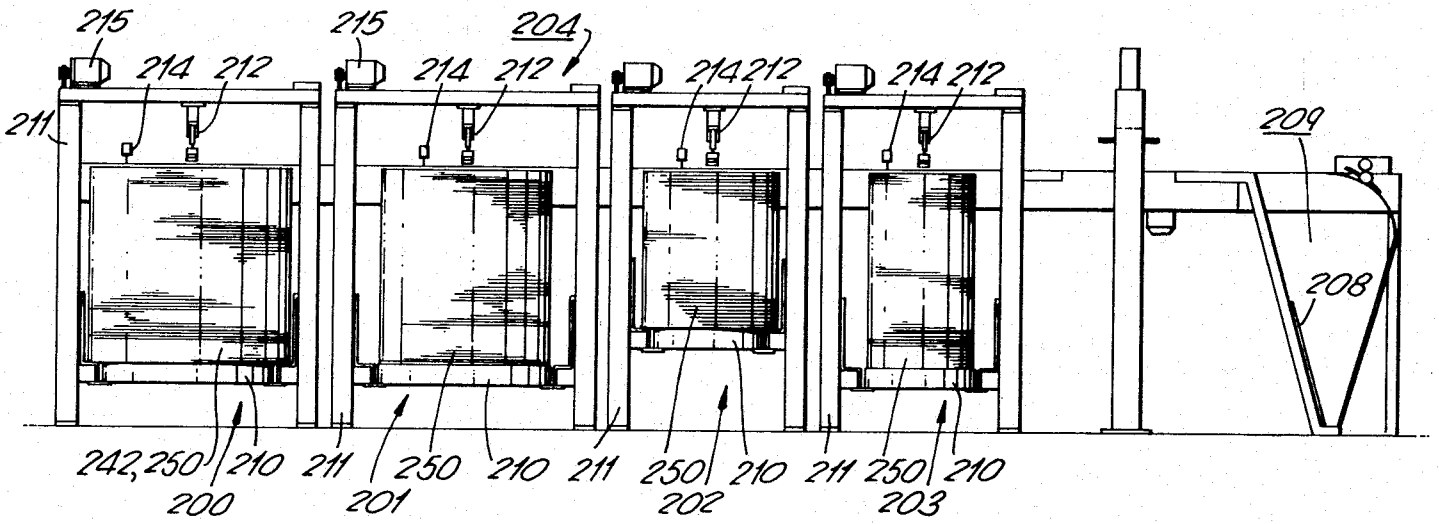
FIG. 11 illustrates generally an equipment comprising, aside from a measuring station not shown, four magazines for blanks, a feeder, and a cutting device.

A second embodiment of the invention will now be described, reference being made to FIGS. 11–13. The arrangements according to this embodiment include a measuring station, not shown, which may be similar to the one according to the previously described embodiment, four disk blank magazines 200, 201, 202 and 203, a feeding device generally designated 204, a cutting unit 205, a shredding device 206 for the waste material, a discharge device 207 for finished disks 208 and a receiving pocket 209 for the finished disks 208.

The four disk blank magazines 200–203 contain disk blanks 242 of four different dimensions. Each magazine 200–203 comprises a staple lifter in a frame 211, a separating unit, an extractor 21 and a centering device 213. Further, there is a level sensing device, generally designated 214, intended to stop the lifting of the staple 250 of blanks when the top blank engages the sensing device, this being done by conventional relays turning off the power supply to a drive motor 215, driving the staple lifter 210 via a power transmission.

When a paper roll arrives at the measuring station and the measurement value has been processed, a signal is fed to that blank magazine 200, 201, 202 or 203 which contains the blanks whose diameter most nearly exceeds the measured value. The staple lifter 210 lifts the staple 250 of blanks until it is level with the level sensing device 214 by means of the motor 215, the separating device lifts the edge of the two top blanks 242, and the extractor 212 moves forward and grips, by means of some gripping device, the two separated blanks, and transports them out onto a feeding table 216.

The feeder, generally designated 204, consists of said feeding table 216, a runner 217 on a guide member 218, which is parallel to the elongated feeding table 216, and a pinching device 219 on an arm 220, which is attached to the runner 217. Further, there are means for the displacement of the runner 217. According to the chosen embodiment these means include an air motor. The feeding table 216 extends along the four blank magazines 200–203 up to the cutting unit 205.

At the same time as the disk blank magazine 200–203 in question receives a signal to have a pair of blanks extracted, the runner 217 gets a signal to fetch the blanks in question from the blank magazine in question. The runner at this time is located at a pre-determined waiting position, such as at a point right before the mid-point between the two central blank magazines 201 and 202. As the signal arrives, the runner 217 is moved by the said air motor to the position of the blanks in question, the pinching device is turned down toward the blanks now extracted onto the feeding table, pinches them by their edges and pulls them into the cutting unit 205. There the pinching device lets go, is turned away, and returns to its waiting position.

The cutting unit 205 consists of a sturdy frame, a horizontal rotatable table 221, a press plate 222, a knife unit 223, a centering unit 224, a catching device 225 for the waste ring, and a cutting device, not shown, for the waste ring.

Figure 12:
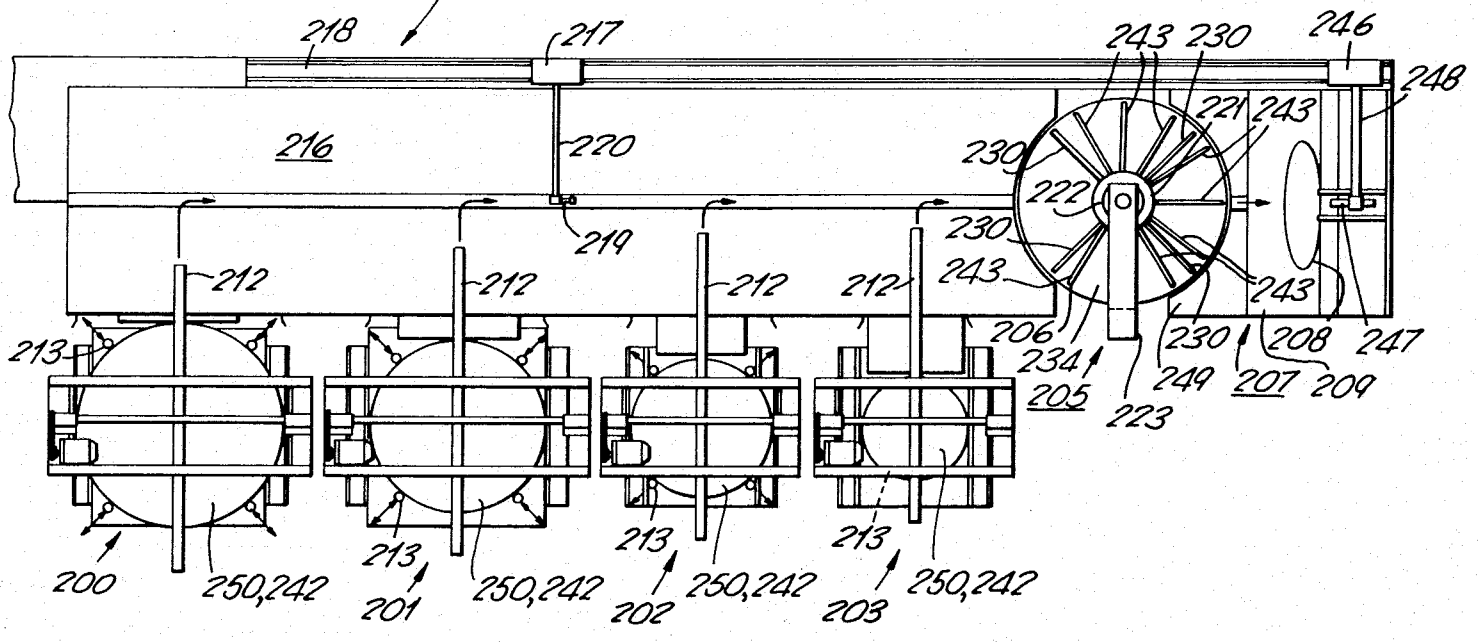
FIG. 12 is an elevation of the equipment according to FIG. 11.
Figure 13:
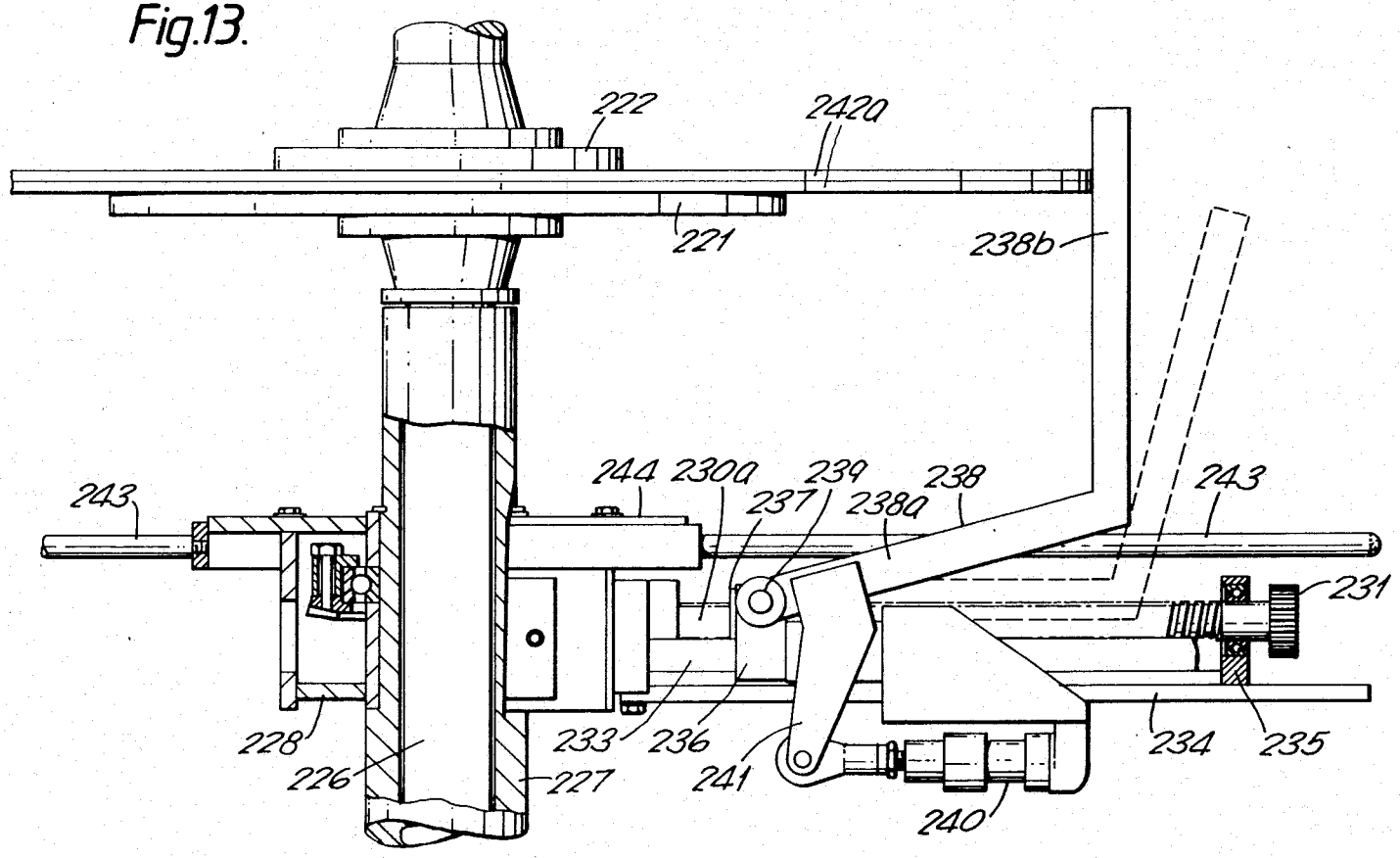
FIG. 13 shows in greater detail how disk blanks may be centered on the cutting table of the cutting device which is part of the assembly of FIGS. 11 and 12.

The table 221, the centering arms 238 with their controls, and the catching arms 243 are schematically depicted in FIG. 12 and in greater detail in FIG. 13. The table 221 is arranged to be able to be turned by means of a drive shaft 226, which turns in a drive shaft housing 227. On the drive shaft housing 227 there is gear-box 228. Through four bearings spaced about the perifery of the gearbox, four radially directed arms 230 extend (only shown on one side in FIG. 13). These arms 230 consists of buttress threaded screws. One of these screws 230—the arm 230a—is provided at its external end with a power transmitting cog wheel 231 which interacts with a driving gear, not shown, the shaft of which is connected to a drive motor, not shown. Inside the gear-box 228 there is a conventional transmission for the transmission of the turning movement of the arm 230a to the other three arms 230. Obliquely below each of the screws 230 there is a sliding rod 233, acting as a guide for a slide 236, to which is attached a nut 237, screwed onto the screw 230. The far end of the screws 230 is journalled in respective bearing houses 235, resting on a plate 234, which is attached to the gear-box 238. The turning of the screws 230 thus brings about the displacement of the nuts 237 according to prior art. On each slide 236 an angled centering arm 238 is rotatably mounted. The turning of the arm about a turning center 239 is accomplished by means of a pneumatic piston arrangement 240 mounted on the slide 236, via a control arm 241. The centering arm 238 comprises an inner part 238a and an outer part 238b. The four outer parts 238b of the centering arms 238 are the active centering devices. The pair of disk blanks which rest on the table 221 have been designated 242a in FIG. 13.

As the extractor 212 feeds blanks onto the feeding table 216 and the feeder 204 with its runner 217, arm 220, and pincher 219 feeds the blanks 242 toward the cutting unit 205, the centering of the blanks 242 is prepared by the turning of the screws 230 so much that the nuts 237 move the centering arms 238 into positions which correspond to the diameter at hand. When the blanks 242 have been left on the table 221 of the cutting device, the piston arrangements 240 are reversed, so that the centering arms 238 are turned up appr. 15° about their turning centers 239. The outer parts 238*b* of the arms 238 are then forced inwards-upwards to vertical position and center the blanks 242*a* between them. The press plate 222 then presses the plate 242*a* against the table 221, and the centering arms are returned by the piston arrangements 240, so that the inner arm parts 238*a* become horizontal and the outer arm parts 238*b* are lowered outwards-downwards to a level below the feeding table 216 and the table 221.

At the same time as the blanks 242*a* are fed to the cutting unit 205 the knife unit 223 also adjusts to the cutting diameter at hand. The knife unit 223 is similar to the knife unit 9 of the embodiment described above, and will therefore not be discussed here. Reference is made to the previous description. The operator now gives a cutting impulse by pressing a button on a control panel. The table 221 starts to rotate, under the influence of the drive shaft 226 and a drive motor, not shown. The knife of the knife unit 223 descends and cuts against a counter roller. As the blanks 242*a* have been cut through, the counter roller moves aside and the waste rings are pressed down into the catching device 225, in the manner described above. In this embodiment, the catching device comprises nine catching arms 243, extending radially from a lid 244 on the gear-box 228. The catching arms 243 are distributed with one arm in each quadrant above the centering arms 238, except in the quadrant facing the feeding table 216, said quadrant being free of catching arms 243. Instead, this quadrant houses the waste material shredding device 206.

When the waste rings have been caught by the catching arms 243 the waste rings are fed in manner analogous to the way described for the previously described embodiment towards the shredding device 206 for waste material, which cuts it into pieces of about 10 cm, said pieces then being fed through a funnel into a collecting device as was described previously. Before this—at the same time as the knife unit and the centering unit are moved into the selected positions—the waste material shredding device has been moved to a position corresponding to the position of the waste ring to be cut into pieces. For this movement, there is a control device similar to the one controlling the knife unit. Instead of a threaded device as in the case of the knife unit, an adjusting device of greater speed is used. An adjusting device of the type marketed under the trade name Movopart®, manufactured and sold by Atlas Copco AB, may be used.

When the finished disks 208 lie free on the table 221 of the cutting unit 205 a second runner 246 on the guide 218 of the extractor unit 207 approaches the edge of the disks and grips them with a gripping unit 247, mounted on an arm 248, and pulls them across a discharge table 249 and over the edge of the receiving pocket 209, where it lets go and the disks fall into the receiving pocket 209. The runner 246 is then returned to a waiting position, waiting for the next discharge cycle. To move the runner along the guide 218 an air motor of the kind used to move the previously mentioned runner 217 may be used.

MODIFICATIONS AND ADDITIONS

It is to be appreciated, that the spirit and scope of the invention in no way is to be limited to the two embodiments described. Within the inventive concept, a multitude of embodiments may thus be envisaged. Common to the two embodiments which have been described in greater detail is that they are to a high degree automated. This is no absolute requirement, however, within a more comprehensive aspect of the invention. Not only acknowledgment to cut the disks may be carried out manually, but also other steps such as feeding the blanks to the cutter and removing finished disks therefrom. The disk blanks need not be circular, as in the case of the embodiments just described. In both cases the disk blanks may very well be square, hexagonal, etc, even if the centering devices then would have to be slightly modified. No particular inventive work is necessary for this. Further it will be appreciated, that the blanks cut in each working cycle need not necessarily be of the same kind. It is thus conceivable to feed for each working cycle blanks from two staples of different materials, e.g. harder and softer, which are then layered one on top of the other in the cutter. Finally, there may be mentioned, among conceivable additions, that the cutter also may be provided with a device which cuts a center hole in the disks simultaneously with the cutting of the edge of the disks. In the simplest case, this device may consist of a hollow cutter which goes down through a hole in the center of the press disk and goes on through a hole in the center of the cutting table. It would also be conceivable to provide a device for the cutting of center holes of different diameters which comprises a radially adjustable knife at the bottom side of the table, working against the bottom side of the press disk through a hole in the table. Other modifications and additions are also possible within the scope of the invention.

What is claimed is:

1. A method of cutting end disks for the packing of paper rolls of variable diameter comprising:

providing a measuring means for measuring the diameter of each paper roll to be packed;

measuring the diameter of a paper roll with said measuring means;

providing at least one disk blank magazine for holding a plurality of disk blanks;

providing a cutting unit comprising a cutting table rotatable about a center axis and a knife which is radially movable relative to said center axis in response to the measured diameter of said paper roll;

feeding a predetermined number of disk blanks for the packing of said paper roll from said disk blank magazine to said cutting unit and fixing said predetermined number of disk blanks to said cutting table for rotation therewith;

moving said knife to a radial position relative to said center axis substantially corresponding to one-half of said measured diameter of said paper roll;

rotating said cutting table about said center axis and engaging said knife with said fixed disk blanks during such rotation to produce cut disks of a diameter substantially corresponding to said measured diameter of said paper roll and annular excess material;

removing said cut disks and said annular excess material separately from said cutting table.

2. The method as claimed in claim 1, further comprising:

providing a catching device for receiving said annular excess material below said cutting table;

pressing said annular excess material downward into said catching device;

providing a shredding unit for cutting said annular excess material into pieces;

feeding said annular excess material in said catching device along a circular path to said shredding unit.

3. The method as claimed in claim 2, further comprising:

providing an upper feeding device for feeding said annular excess material in said catching device along a circular path to said shredding unit, said upper feeding device movable between a position above said catching device for feeding said annular excess material to said shredding unit and a position adjacent said catching device for allowing said annular excess material to be received in said catching device;

moving said upper feeding device to said position adjacent said catching device to allow said annular excess material to be pressed downward into said catching device and then returning said upper feeding device to said position above said catching device to feed said annular excess material to said shredding unit.

4. A device for automatically cutting end disks for the packing of paper rolls of variable diameter coming off a paper roll production line comprising:

measuring means for successively measuring the diameter of each paper roll;

magazine means for holding a plurality of disk blanks;

expulsion means for expelling a predetermined number of disk blanks for the packing of said paper roll from said magazine means;

cutting unit means, receivable of said expelled disk blanks, for supporting said expelled disk blanks during cutting, said cutting unit means comprising a cutting table means, rotatable about a center axis, for supporting said expelled disk blanks, a driving means for rotating said cutting table about said center axis, and fixing means for releasably fixing said expelled disk blanks to said cutting table means, transverse to said center axis, for rotation therewith about said center axis;

knife unit means, including a knife radially movable with respect to said center axis, for cutting annular excess material off said expelled disk blanks;

displacement means, operatively connected to said measuring means and said knife unit means, for supporting said knife unit means and for moving said knife to a radial position relative to said center axis substantially corresponding to one-half of said measured diameter of said paper roll and moving said knife in a direction parallel to said center axis through said expelled disk blanks at said radial position during rotation of said cutting table.

5. The device as claimed in claim 4, further comprising catching means for receiving the annular excess material cut from said disk blanks, shredding means for cutting said annular excess material into pieces, feed means for feeding the annular excess material in said catching means to said shredding means.

6. The device as claimed in claim 5, wherein said catching means is disposed beneath said cutting table.

7. The device as claimed in claim 6, wherein said feed means comprises a movable upper feeding roll and a lower feeding roll, said upper feeding roll being movable between a first position above said lower feeding roll wherein said upper and lower feeding rolls cooperate to feed said annular excess material to said shredding means and a second position aside said lower feeding roll wherein said annular excess material may be received by said catching means, motor means for moving said upper feed roll between said first and second positions.

8. The device as claimed in claim 4, further comprising support means for supporting said cutting unit means, said support means being rotatable about a horizontal axis.

9. The device as claimed in claim 8, wherein said support means comprises a lower framework, an upper framework and a connecting framework, said connecting framework being rigidly connected to said lower framework and to said upper framework, said connecting framework holding upper framework and said lower framework in overlapping, parallel, spaced apart relationship, said cutting table being rotatably mounted on said lower framework, said displacement means being mounted on said upper framework, said fixing means comprising a rotatable press plate mounted on said upper framework, said press plate being rotatable about said center axis and movable from a position pressingly engageable of said disk blanks supported on said cutting table to a position free of said disk blanks.

10. The device as claimed in claim 5, wherein said shredding means is located essentially diametrically opposite said knife unit means relative to said center axis.

11. The device as claimed in claim 4, wherein said magazine means comprises a plurality of magazines, each magazine containing disk blanks of a different predetermined diameter; and wherein said expulsion means is operatively connected to said measuring means so as to expel disk blanks from the magazine containing the disk blank most closely exceeding said measured roll diameter; and further comprising transporter means for transporting said expelled disk blanks to said cutting unit means.

12. The device as claimed in claim 4, wherein said cutting table is horizontal and further comprising discharge means for removing cut disks from said cutting table.

* * * * *